US009512688B2

(12) United States Patent
Hallundbæk

(10) Patent No.: US 9,512,688 B2
(45) Date of Patent: Dec. 6, 2016

(54) ARM ASSEMBLY

(75) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 504 days.

(21) Appl. No.: 14/007,754

(22) PCT Filed: Mar. 29, 2012

(86) PCT No.: PCT/EP2012/055645
§ 371 (c)(1),
(2), (4) Date: Sep. 26, 2013

(87) PCT Pub. No.: WO2012/130945
PCT Pub. Date: Oct. 4, 2012

(65) Prior Publication Data

US 2014/0013731 A1 Jan. 16, 2014

(30) Foreign Application Priority Data

Mar. 30, 2011 (EP) ..... 11160499

(51) Int. Cl.
*E21B 23/00* (2006.01)
*E21B 23/14* (2006.01)

(52) U.S. Cl.
CPC ..... *E21B 23/00* (2013.01); *E21B 23/14* (2013.01); *E21B 2023/008* (2013.01)

(58) Field of Classification Search
None
See application file for complete search history.

(56) References Cited

U.S. PATENT DOCUMENTS 6,273,189 B1 8/2001 Gissler et al.
6,629,568 B2 10/2003 Post et al.
2005/0145415 A1 7/2005 Doering et al.
(Continued)

FOREIGN PATENT DOCUMENTS

RU 2175374 C1 10/2001
RU 2354801 C2 7/2008
(Continued)

OTHER PUBLICATIONS

International Preliminary Report on Patentability issued in International Patent Application No. PCT/EP2012/055645 issued on Oct. 1, 2013.
(Continued)

*Primary Examiner* — Jennifer H Gay
*Assistant Examiner* — Caroline Butcher
(74) *Attorney, Agent, or Firm* — Nixon & Vanderhye, P.C.

(57) ABSTRACT

A downhole tool extending in a longitudinal direction includes a tool housing, an arm assembly movable between a retracted position and a projecting position in relation to the tool housing, the arm assembly having an arm member connected with the tool housing in one end, an arm activation assembly arranged in the tool housing for moving the arm assembly between the retracted position and the projecting position, and a pump for circulating hydraulic fluid. The arm assembly has a hydraulic mechanism arranged in connection with the arm member, and a fluid influx channel provided in the arm member, the fluid influx channel being in fluid communication with the hydraulic mechanism for supplying hydraulic fluid from the pump to the hydraulic mechanism.

17 Claims, 12 Drawing Sheets

(56) References Cited

U.S. PATENT DOCUMENTS

| | | | | |
|---|---|---|---|---|
| 2008/0156477 | A1* | 7/2008 | Aivalis | E21B 23/00 166/53 |
| 2010/0012315 | A1 | 1/2010 | McInally | |
| 2012/0037358 | A1 | 2/2012 | Ferkingstad et al. | |

FOREIGN PATENT DOCUMENTS

| | | |
|---|---|---|
| RU | 2353751 C2 | 4/2009 |
| WO | WO 93/18277 | 9/1993 |
| WO | WO 2006/115418 | 11/2006 |
| WO | WO 2008/091157 | 7/2008 |
| WO | WO 2008/111844 | 9/2008 |
| WO | WO 2009/020397 | 2/2009 |
| WO | WO 2010/123375 | 10/2010 |

OTHER PUBLICATIONS

International Search Report for PCT/EP2012/055645 mailed May 29, 2012.
Written Opinion of the International Searching Authority mailed May 29, 2012.
Decision to Grant dated Jun. 20, 2016 issued in Russian Application No. 2013147725/03 (9 pages).

* cited by examiner

ARM ASSEMBLY

This application is the U.S. national phase of International Application No. PCT/EP2012/055645 filed 29 Mar. 2012 which designated the U.S. and claims priority to EP 11160499.7 filed 30 Mar. 2011, the entire contents of each of which are hereby incorporated by reference.

FIELD OF THE INVENTION

The present invention relates to a downhole tool, comprising a tool housing, an arm assembly movable between a retracted position and a projecting position in relation to the tool housing, the arm assembly comprising an arm member connected with the tool housing in one end, an arm activation assembly arranged in the tool housing for moving the arm assembly between the retracted position and the projecting position, and a pump for circulating hydraulic fluid. Furthermore, the invention relates to a downhole system comprising the downhole tool according to the invention and an operational tool.

BACKGROUND ART

Downhole tools are used for operations inside boreholes of oil and gas wells. Downhole tools operate in a very harsh environment and must be able to withstand inter alia corrosive fluids, very high temperatures and pressure.

To avoid unnecessary and expensive disturbances in the production of oil and gas, the tools deployed downhole have to be reliable and easy to remove from the well in case of a breakdown. Tools are often deployed at great depths several kilometers down the well, and removing jammed tools are therefore a costly and time-consuming operation.

Well tools are often part of a larger tool string containing tools with different functionalities. A tool string may comprise both transportation tools for propelling the tool string in the well and operational tools for performing various operations downhole.

Well tools often utilise hydraulics for performing operations or providing propulsion in transportation tools, also denoted well tractors. Supplying pressurised hydraulic fluid to various parts of a downhole tool requires a reliable and robust hydraulic system, as tools in the well cannot be accessed easily.

Especially the supply of hydraulic fluid into moving parts and/or extremities of a downhole tool is challenging. In regular machines, this is often accomplished by utilising external, flexible hydraulic hoses, which provides great freedom of design. In downhole tools the use of external hoses is undesirable due to the risk of hoses getting torn or the tool getting stuck due to entangled hoses.

SUMMARY OF THE INVENTION

It is an object of the present invention to wholly or partly overcome the above disadvantages and drawbacks of the prior art. More specifically, it is an object to provide an improved downhole tool wherein hydraulic fluid can be supplied to a hydraulic mechanism, e.g. a hydraulic cylinder or motor associated with the downhole tool.

The above objects, together with numerous other objects, advantages, and features, which will become evident from the below description, are accomplished by a solution in accordance with the present invention by a downhole tool extending in a longitudinal direction, comprising a tool housing, and an arm assembly movable between a retracted position and a projecting position in relation to the tool housing, the arm assembly comprising an arm member connected with the tool housing in one end, the tool housing further comprising an arm activation assembly arranged in the tool housing for moving the arm assembly between the retracted position and the projecting position, and a pump for circulating hydraulic fluid, wherein the arm assembly comprises a hydraulic mechanism arranged in connection with the arm member, and a fluid influx channel provided in the arm member, the fluid influx channel being in fluid communication with the hydraulic mechanism for supplying hydraulic fluid from the pump to the hydraulic mechanism.

Hereby, fluid can be supplied through the arm member to the hydraulic mechanism using internal fluid channels as an alternative to external fluid channels such as hydraulic hoses. The use of internal fluid channels provides a more robust hydraulic circuit and reduces the risk of the sealing properties of the hydraulic circuit being compromised when the downhole tool is deployed in the well.

In one embodiment, the hydraulic mechanism may be a hydraulic motor or a hydraulic cylinder, and the fluid influx channel may be fluidly connected with the hydraulic motor or hydraulic cylinder for supplying hydraulic fluid from the pump to the hydraulic mechanism.

Further, the arm assembly may comprise a rotational part connected with the hydraulic motor, whereby the rotational part is rotated by the hydraulic motor to propel the downhole tool in a well.

Said rotational part may comprise a wheel ring providing a wheel for propelling the downhole tool.

Moreover, the hydraulic motor may rotate around an axis of rotation, and the wheel ring of the rotational part may rotate around an axis of rotation coinciding with the axis of rotation of the hydraulic motor.

Hereby, the hydraulic motors comprised in each of the arm assemblies provide the force needed to propel the downhole tool in the well. By having the motor arranged in proximity to the rotational part or wheel ring, the complexity of the transmission between the motor and the wheel ring is reduced. Further, by each wheel ring being rotated by a dedicated motor, the downhole tool will continue to function if one or more motors break down.

In one embodiment, a fluid reflux channel may be provided in the arm member, the fluid reflux channel being in fluid communication with the hydraulic mechanism to drain hydraulic fluid from the hydraulic mechanism.

Also, the arm member may further comprise a through hole extending from one side of the arm member to another, thereby defining a circumferential wall, and the arm activation assembly may further comprise a torque member received in the through hole, thereby connecting the arm member with the arm activation assembly.

In addition, an inlet of the fluid influx channel and an outlet of the fluid reflux channel may be arranged in the circumferential wall encircling the through hole.

Said circumferential wall encircling the through hole may comprise multiple grooves and protrusions extending from one side of the arm member to another, and the multiple grooves of the circumferential wall may be adapted to receive corresponding protrusions provided in the torque member.

Furthermore, the grooves of the circumferential wall encircling the through hole may comprise faces and the protrusions provided in the torque member may comprise faces, the faces of the circumferential wall and the faces of the torque member abutting against each other when the torque member is received in the through hole of the arm member.

Moreover, the torque member may comprise a first fluid channel fluidly connected to the fluid influx channel of the arm member and a second fluid channel fluidly connected to the fluid reflux channel of the arm member.

In one embodiment, the arm activation assembly may comprise a piston chamber and a piston member movable in the longitudinal direction of the downhole tool and arranged inside the piston chamber, wherein the torque member may be rotated by the piston member to move the arm assembly between the retracted position and the projecting position.

Additionally, the arm assembly may comprise a motor housing arranged at one end of the arm member, the motor housing and the rotational part defining an inner space in which the hydraulic motor is arranged, wherein an outlet of the fluid influx channel and an inlet of the fluid reflux channel are fluidly connected to the inner space.

Said motor housing may comprise a circumferential housing wall constituted by a protruding part of the arm member, whereby the motor housing is provided as an integrated part of the arm member.

Hereby, the number of fluid channel interfaces in the arm assembly is reduced, as the inlet and outlet of the fluid channels of the arm member are provided in the inner space of the motor housing and thus fed directly into the hydraulic motor. If the motor housing is mounted as a separate unit onto the arm member, an interface would have to be provided between the fluid channels of the arm member and the inlet and outlet in the inner space of the motor housing.

Also, the arm assembly may further comprise a tube member arranged in a bore provided in the arm member, the bore extending from one side of the arm member to the through hole, wherein a first end of the tube member extends through the bore and into engagement with one of the fluid channels of the torque member received in the through hole, whereby the torque member is secured in the through hole of the arm member.

Further, the tube member may comprise an inner bore extending between an inlet arranged in the first end of the tube member and an outlet provided in a side wall of the tube member, wherein the tube member fluidly connects the first fluid channel of the torque member and the fluid influx channel of the arm member.

Said tube member may be a threaded bolt.

The present invention further relates to a downhole system comprising the downhole tool according to the invention and an operational tool connected with the downhole tool for being moved forward in a well or borehole. The operational tool may be a stroker tool, a key tool, a milling tool, a drilling tool, a logging tool, etc.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
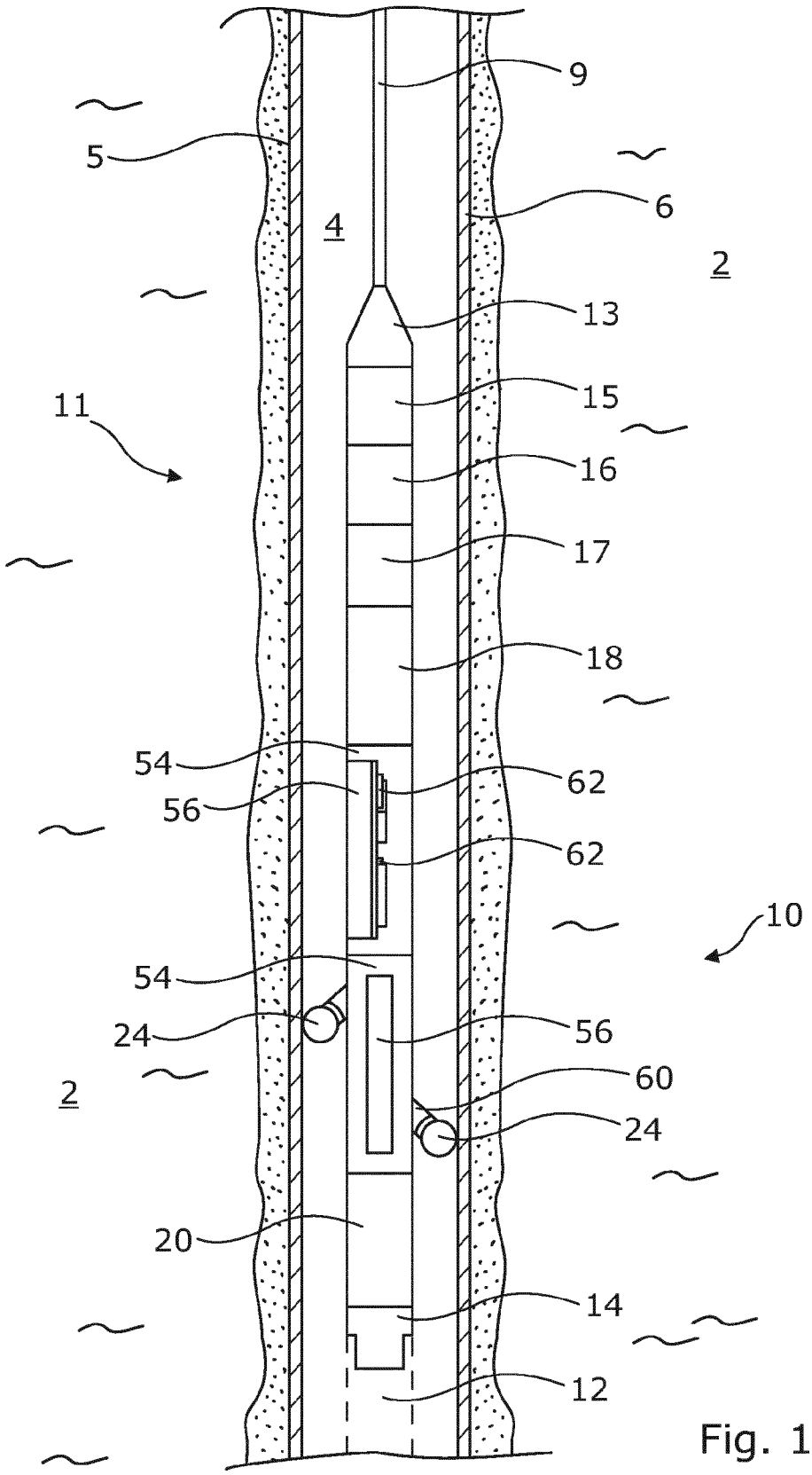
FIG. 1 shows a downhole tool suspended in a well with arms in a projecting position.
Figure 3:
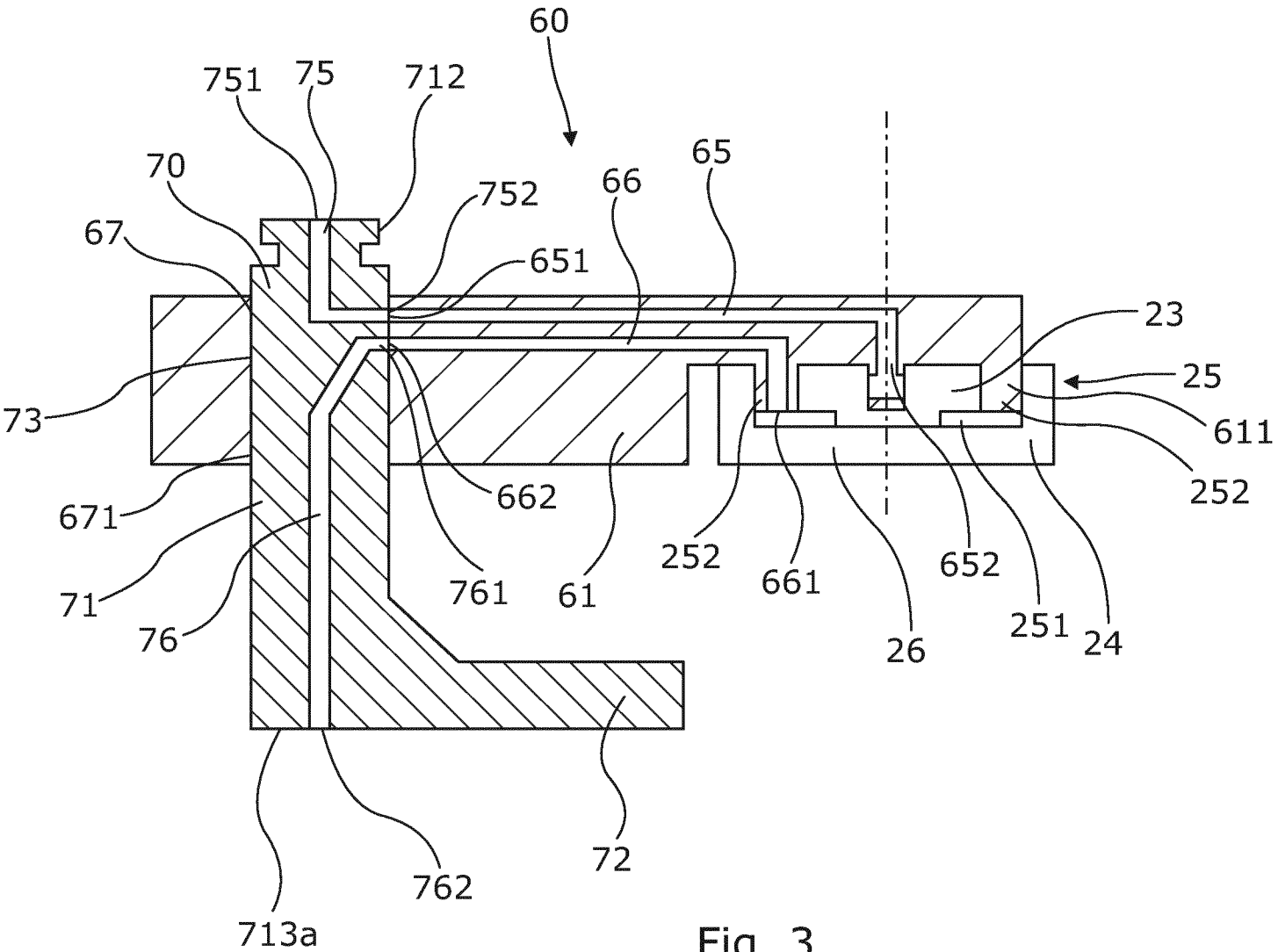
FIG. 3 shows a cross-sectional side view of an arm assembly and a torque member.

FIG. 1 shows a tool string 10 comprising a downhole tool 11 suspended in a well bore 4 or cased well. The downhole tool comprises several arm assemblies 60 projecting from the downhole tool towards the casing 6 or side walls of the well. The arm assemblies 60 can be moved between a retracted position and a projecting position. As shown in FIG. 3, the arm assemblies 60 each comprise a hydraulic mechanism 23, 62, such as a hydraulic motor 23 or hydraulic cylinder 62 (shown in FIG. 7) for converting hydraulic pressure into mechanical motion. Accordingly, the downhole tool 11 may have varying functionalities depending on the configuration of the arm assemblies 60. By providing the arm assemblies 60 with wheel rings 24 connected with a hydraulic motor 23, the downhole tool 11 may e.g. be used as a transportation tool, wherein projecting wheel rings rotate to drive forward the downhole tool or tool string. The downhole tool 11 may also be used for adjusting sliding sleeves or valves downhole by the arm assemblies comprising hydraulic cylinders.

The downhole tool 11 or tool string 10 is suspended from and powered through a wireline 9 which is connected with the tool through a top connector 13. The downhole tool 11 further comprises an electronic section having mode shift electronics 15 and control electronics 16. The electronic section controls the electricity supply before it is directed to an electrical motor 17 driving a hydraulic pump 18.

Figure 2:
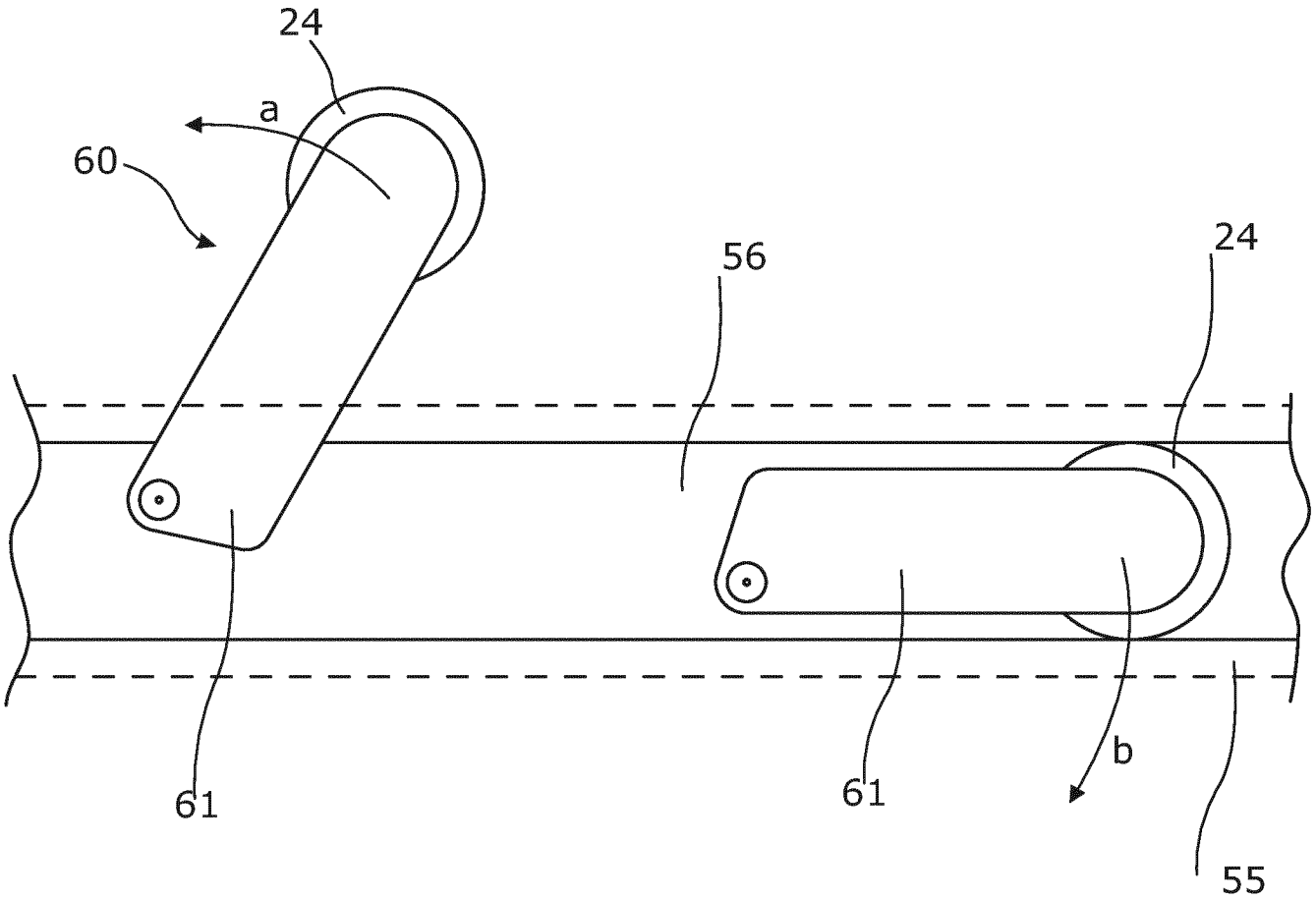
FIG. 2 shows, for illustrative purposes, a top view of part of a downhole tool with one arm assembly in a projecting position and another arm assembly in a retracted position.

The downhole tool 11 extends in a longitudinal direction and comprises one or more tool housings 54 arranged end to end with their respective end faces connected with each other. The downhole tool 11 further comprises multiple arm assemblies 60 (shown in FIG. 2) and multiple arm activation assemblies 40 (shown in FIG. 6) for moving the arm assemblies between the retracted position and the projecting position. In FIG. 2, two arm assemblies 60 are shown in the projecting position and the retracted position, respectively, for illustrative purposes as the arm assemblies in a downhole tool according to the invention usually move in a synchronised manner wherein all the arm assemblies are either retracted or projecting at the same time.

FIG. 3 shows an arm assembly 60 comprising an arm member 61, a hydraulic motor 23 arranged in a motor housing 25 and a rotational part 26 provided with a wheel ring 24. The arm member 61 and the rotational part 26 constitute the motor housing 25. In one end of the arm member, a part of the arm member protrudes to provide a circumferential housing wall 252 of the motor housing 25. By the circumferential housing wall being constituted by a protruding part of the arm member, the motor housing 25 becomes an integrated part of the arm member 61. In another design, the circumferential housing wall 252 is provided by a separate member being connected to the arm member, e.g. by a threaded connection. Such design also requires a seal between the circumferential housing wall 252 and the arm member 61. A hydraulic motor 23 is arranged inside the motor housing 25. The rotational part 26 provides a closure for the motor housing, thereby providing a sealed off inner space adapted to contain the hydraulic motor 23. The hydraulic motor 23 is a conventional hydraulic motor known to the person skilled in the art, such as a radial piston motor. When hydraulic fluid is supplied to the hydraulic motor, part of the hydraulic motor rotates. The hydraulic motor 23 consequently rotates the rotational part 26 and thus the wheel ring 24 so that when the downhole tool 11 is suspended downhole and the arm assemblies 60 are in their projecting position, the wheel ring 24 provides traction against the side wall of the well or casing.

Figure 7:
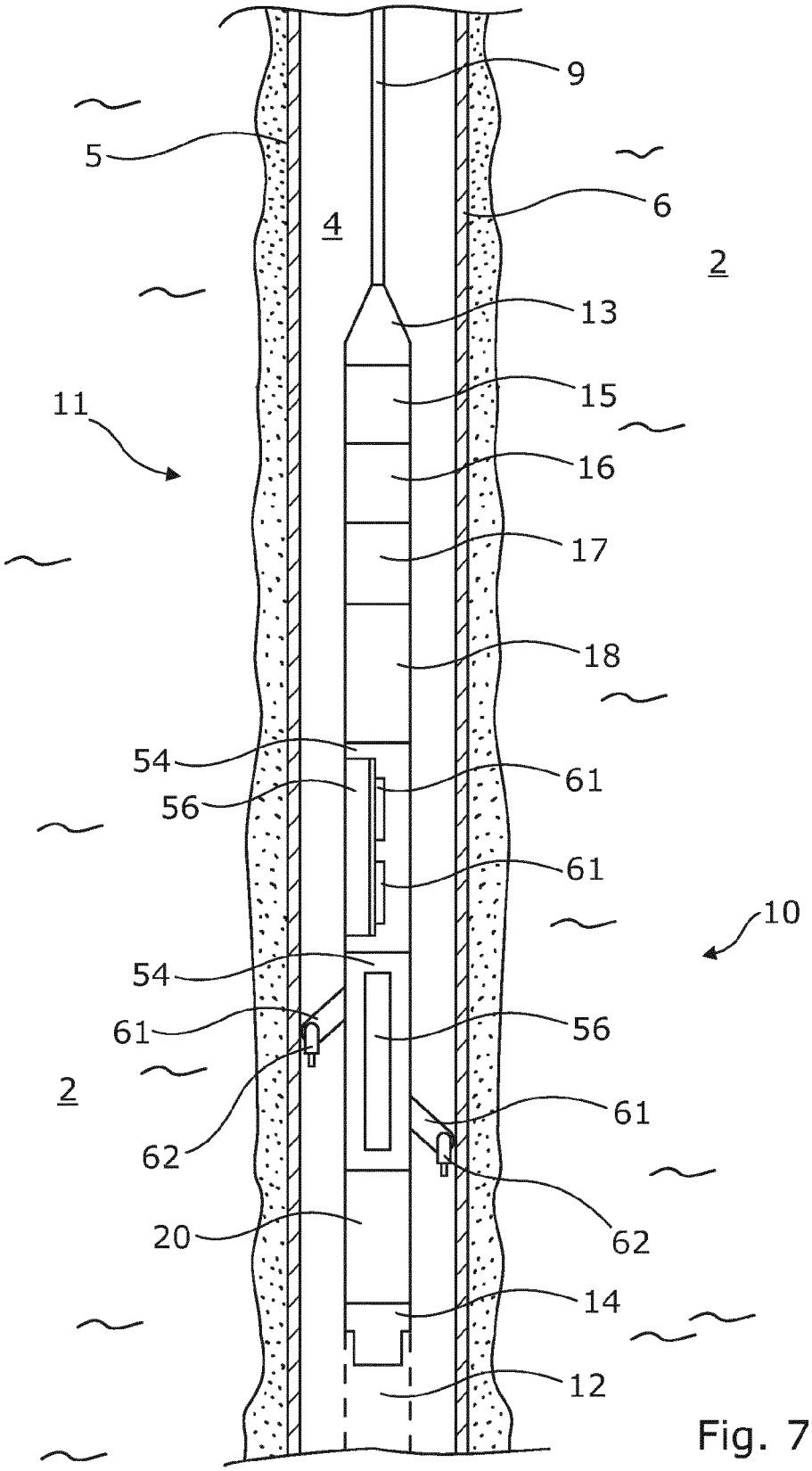
FIG. 7 shows a downhole tool suspended in a well with projecting arms comprising hydraulic cylinders.

In another design, the rotational part 26 may be omitted and the hydraulic motor substituted by a different hydraulic mechanism such as, but not limited to, a hydraulic cylinder, a piston, a cutting device, a drilling device, etc. In FIG. 7, a downhole tool comprising hydraulic cylinders is shown. The hydraulic cylinders 62 are a part of the arm assemblies and arranged at an end of the member. When activated, the hydraulic cylinders provide a linear force that may be used for setting sliding sleeves, adjusting valves, or performing other operations downhole.

As shown in FIG. 3, the arm member 61 comprises internal fluid channels to supply hydraulic fluid to the hydraulic motor 23. Reference number 65 denotes a fluid influx channel extending between an inlet 651 and an outlet 652 arranged in fluid communication with the inner space of the motor housing 25. The fluid influx channel supplies hydraulic fluid to the hydraulic motor arranged in the motor housing. Reference number 66 denotes a fluid reflux channel extending from an inlet 661 in fluid communication with the inner space and an outlet 662. The fluid reflux channel provides a drain for hydraulic fluid supplied to the hydraulic motor and the inner space. The hydraulic fluid enters the hydraulic motor through outlet 652 of the fluid influx channel. When the hydraulic fluid has been used in the hydraulic motor 23, the hydraulic fluid enters the inner space 251 from which it is drained through the inlet 661 and the fluid reflux channel.

Figure 4:
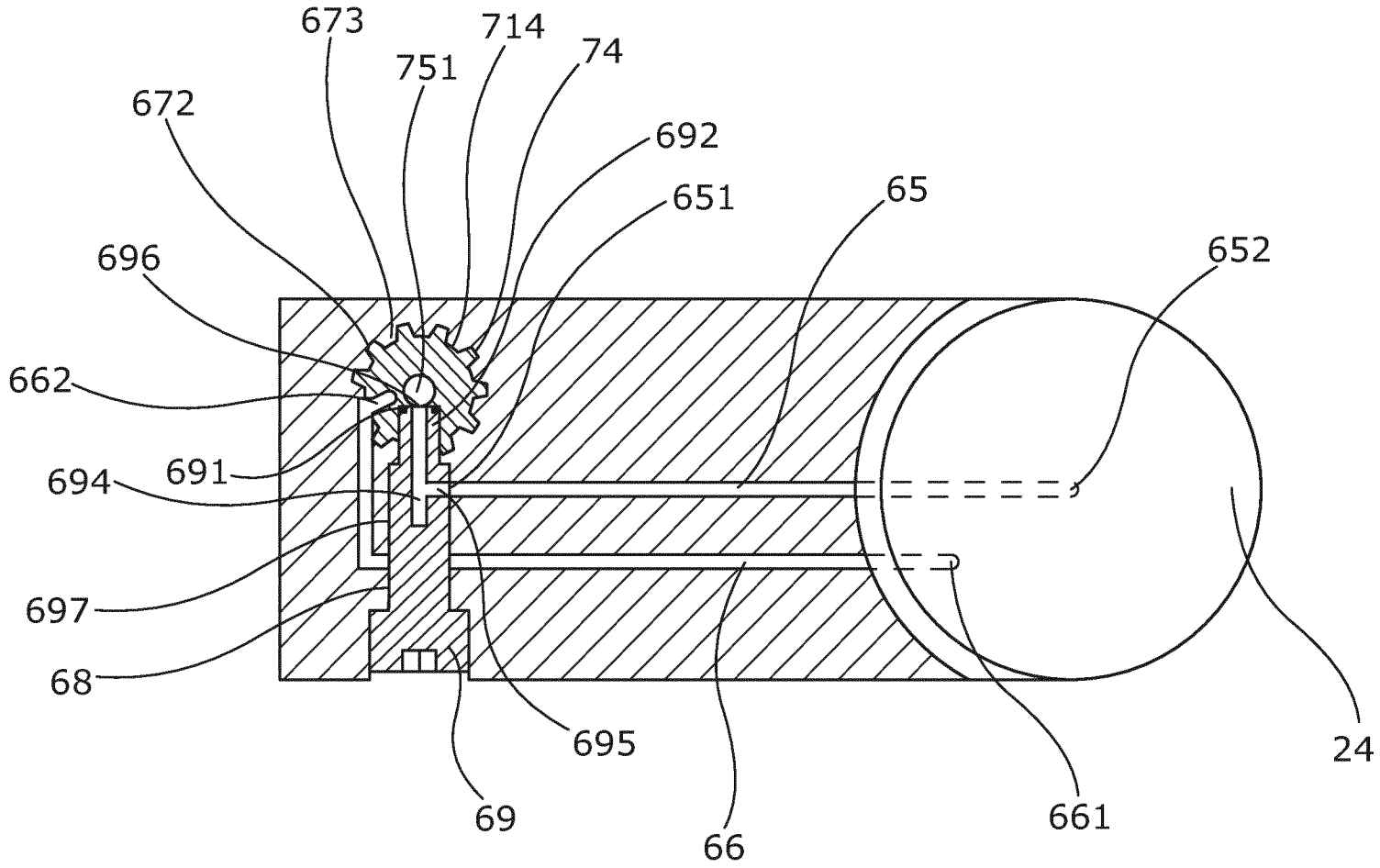
FIG. 4 shows an arm assembly comprising a tube member.

The outlet 652 of the fluid influx channel and the inlet 661 of the fluid reflux channel may be arranged in several different positions in relation to the layout of the motor housing. As shown in FIG. 4, the outlet 652 of the fluid influx channel is arranged near the centre of the wheel 24, i.e. near the centre of the motor housing 25 (shown in FIG. 3), and the inlet 661 of the fluid reflux channel is arranged closer to the periphery of the motor housing. More specifically as shown in FIG. 3, the outlet 652 of the fluid influx channel is provided in a protruding part of the arm member, and the inlet 661 of the fluid reflux channel is provided in the circumferential housing wall of the motor housing 25. However, the inlet 661 of the fluid reflux channel may also be arranged near the centre of the motor housing and the outlet 652 of the fluid influx channel closer to the periphery.

Figure 10:
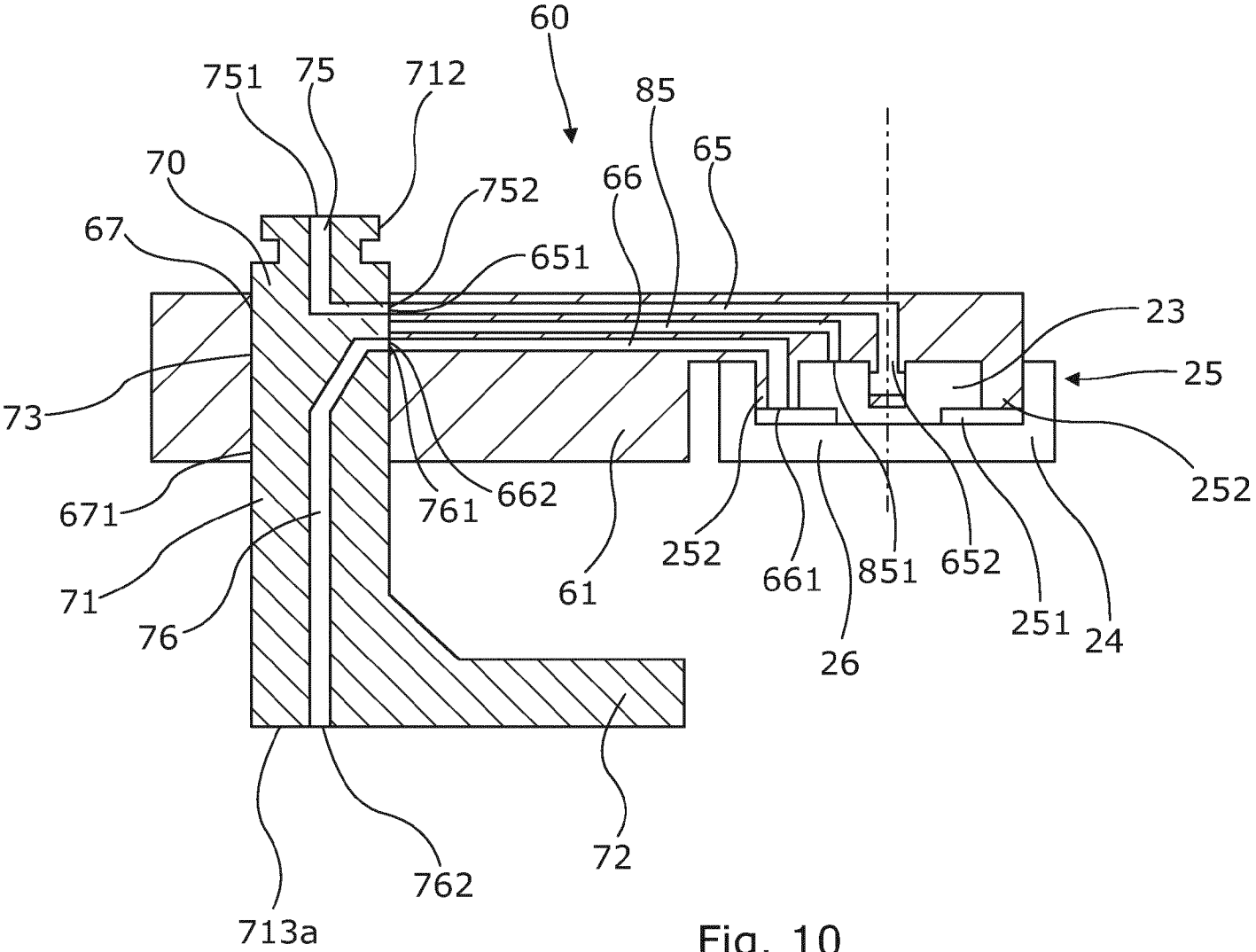
FIG. 10 shows a cross-sectional side view of another arm assembly.
Figure 11:
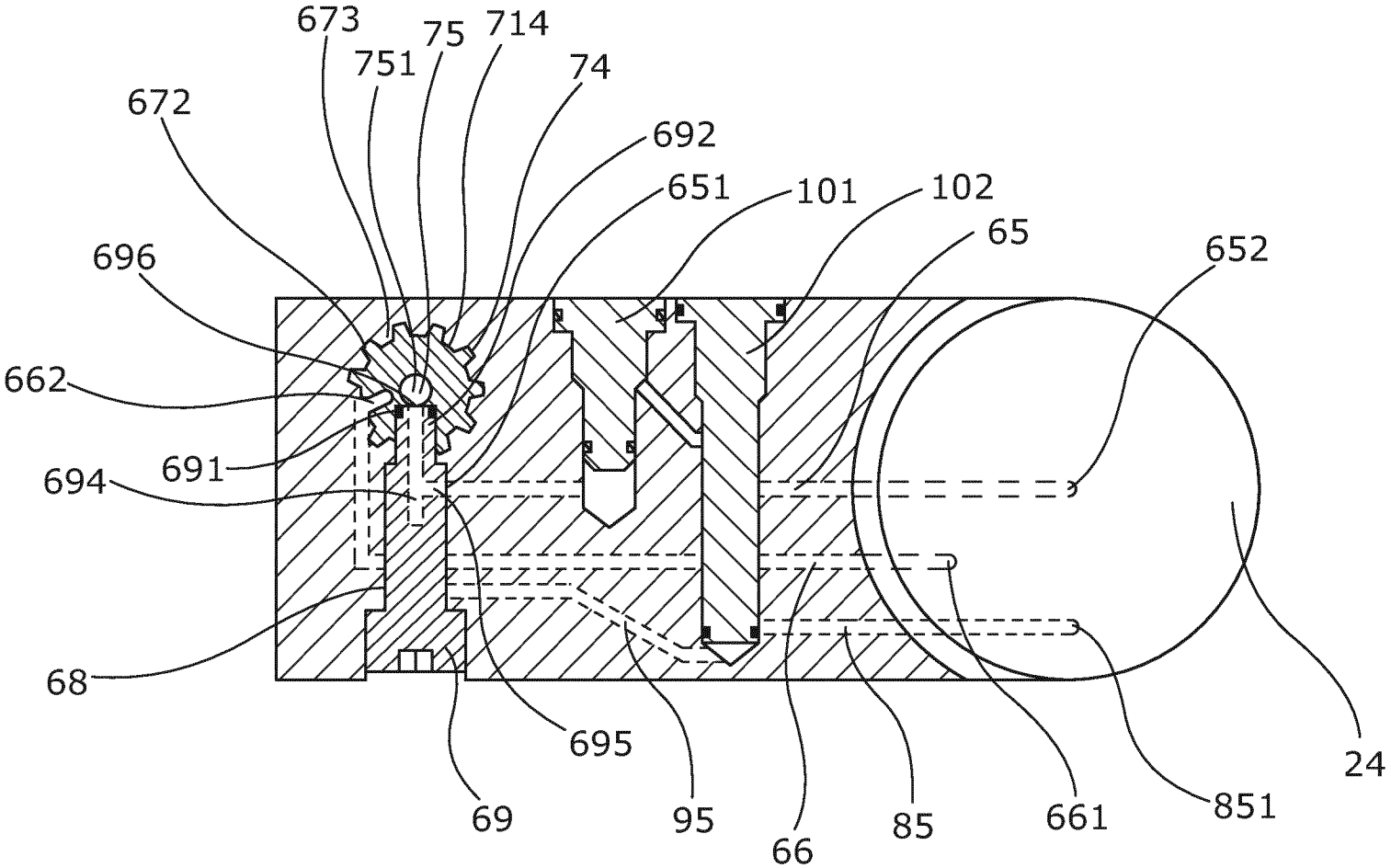
FIG. 11 shows an arm assembly comprising an anti-spin valve and a direction valve.
Figure 12:
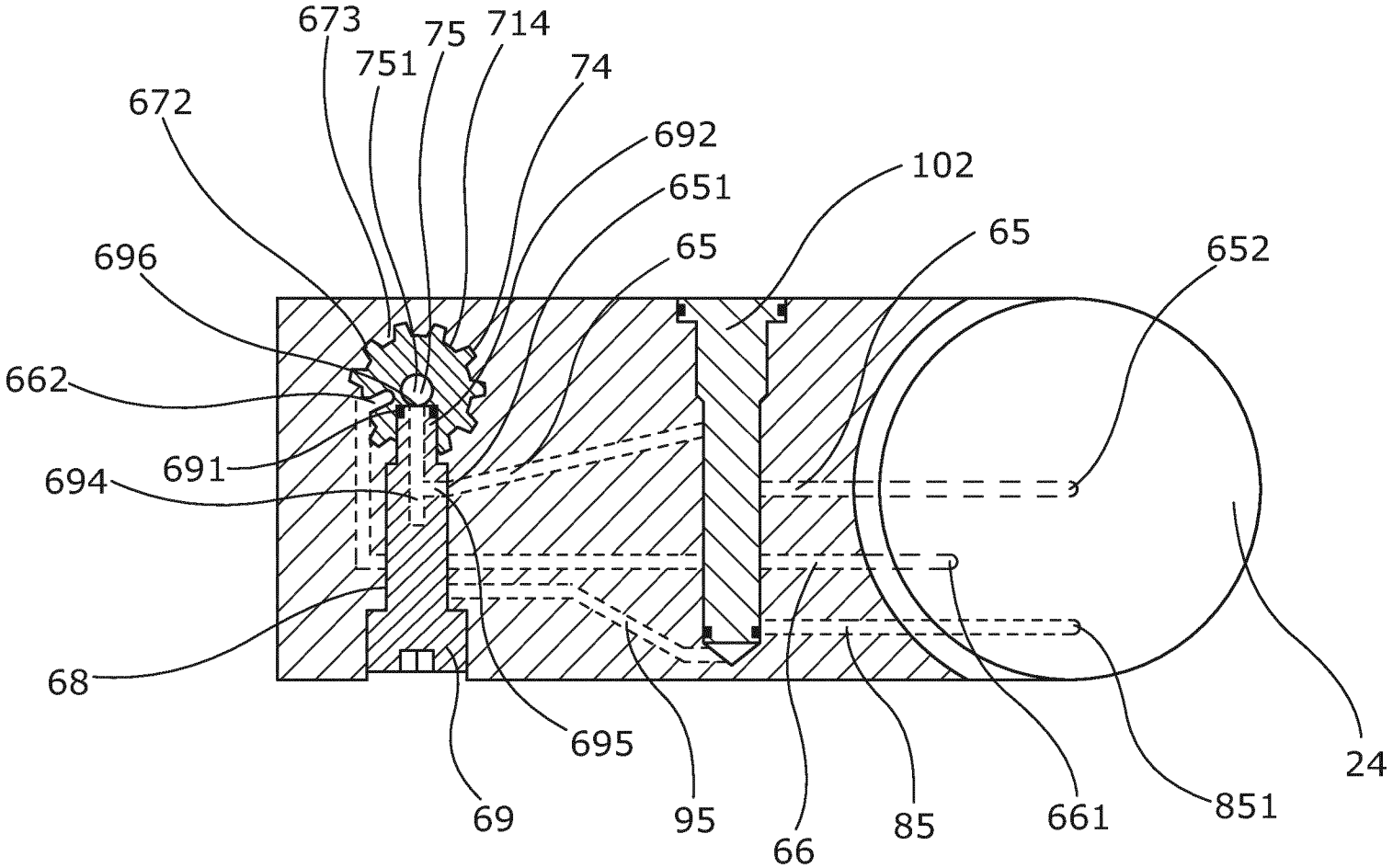
FIG. 12 shows an arm assembly comprising a direction valve.

As shown in FIGS. 10-12, the arm member 61 may comprise an additional internal fluid channel providing a second fluid influx channel 85 terminating in an outlet 851 in the motor housing. By providing a second fluid influx channel 85, the hydraulic motor may be rotated in both a clockwise and a counterclockwise direction. Hereby, the hydraulic motor may be used to drive the downhole tool or tool string forwards or backwards depending on the direction of rotation of the hydraulic motor. If the hydraulic fluid is supplied to the hydraulic motor via the influx channel 65, hydraulic fluid is supplied to the pistons of the hydraulic motor in a predetermined sequence, rotating the hydraulic motor in one direction. Likewise, if the hydraulic fluid is supplied to the hydraulic motor via the second influx channel 85, hydraulic fluid is supplied to the pistons of the hydraulic motor in a different predetermined sequence, rotating the hydraulic motor in the opposite direction. Whether the hydraulic fluid is supplied via the influx channel 65 or second influx channel 85 may be controlled by a direction valve 102 provided in a bore in the arm member 61. The direction valve 102 is adapted to direct the flow of hydraulic fluid into either the influx channel 65 or the second influx channel 85. The direction valve 102 is controlled by a pilot pressure supplied via a pilot channel 95 in the arm member 61. By controlling the pilot pressure, the direction valve 102 may be set to direct the supply of hydraulic fluid into either the influx channel 65 or the second influx channel 85. The pilot pressure may be the pressure used to move the arm assembly between the retracted position and a projecting position in relation to the tool housing, as described further below.

Figure 8:
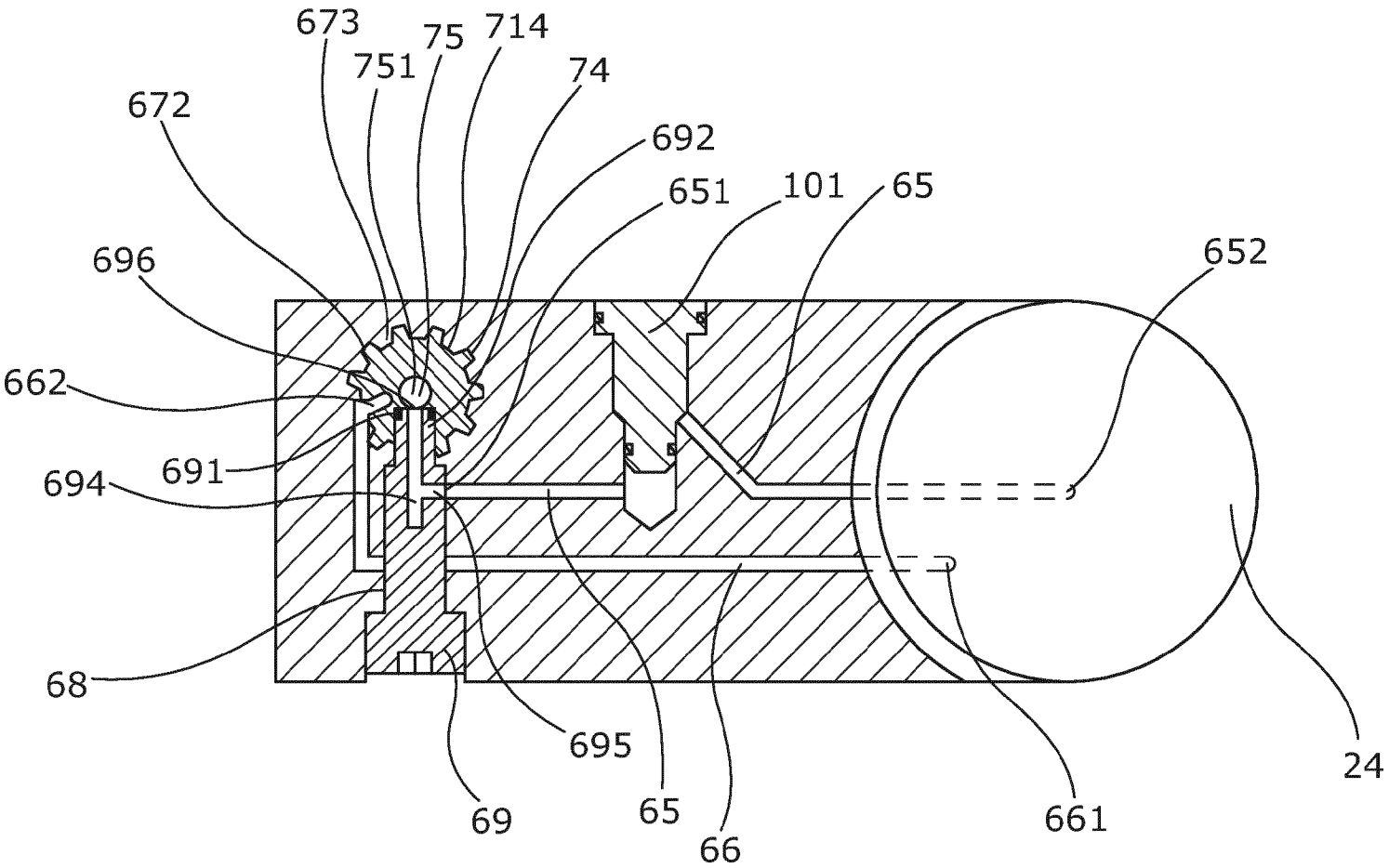
FIG. 8 shows an arm assembly comprising an anti-spin valve.
Figure 9A:
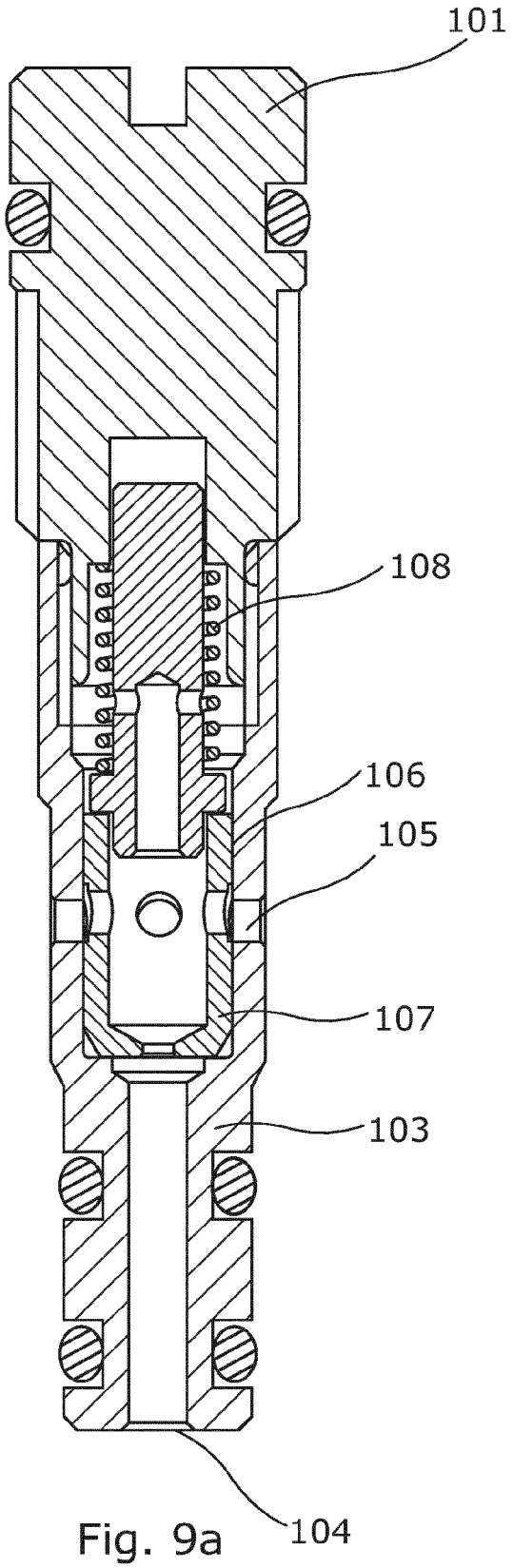
FIGS. 9*a* and 9*b* show an anti-spin valve in an open and a closed position, respectively.
Figure 9B:
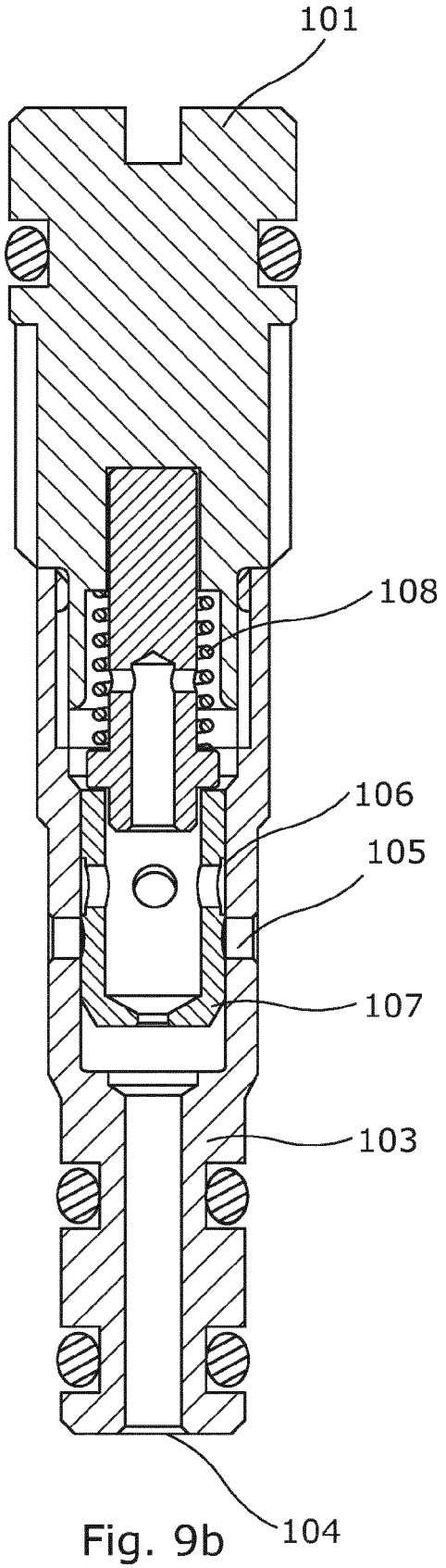

As shown in FIG. 8 and FIG. 11, the arm member 61 may further comprise an anti-spin valve 101, shown in more detail in FIG. 9*a* and FIG. 9*b*. The anti-spin valve 101 controls the flow through the influx channel 65 to ensure traction between the wheel ring 24 and the side wall 697 of the well or casing. When traction is substantially lost, the wheel ring 24 and the rotational part 26 rotate without providing the necessary forward motion of the downhole tool or tool string. When this happens, the flow through the hydraulic motor increases and the pressure consequently drops. To prevent spinning, the anti-spin valve 101 restricts the flow through the influx channel whereby the rotational speed of the rotational part 26 and the wheel ring 24 is reduced and traction regained.

In FIG. 9*a*, the anti-spin valve 101 is shown in an open position not restricting the flow through the influx channel. The anti-spin valve 101 comprises a valve body 103 having an inlet 104, through which hydraulic fluid enters, and an outlet 105, through which hydraulic fluid exits. In a centre bore 106 of the anti-spin valve, a spring-loaded closing member 107 is provided. When the closing member 107 is in the open position as shown in FIG. 9*a*, the hydraulic fluid flows unrestrictedly through the anti-spin valve. The pressure in the hydraulic motor and the force of the spring 108 keep the closing member in the open position. When the pressure in the hydraulic motor drops due to spinning of the wheel ring 24, the pressure in the hydraulic motor and the spring force is no longer adequate to keep the anti-spin valve in the open position, and the pressure in the influx channel displaces the closing member, whereby flow through the anti-spin valve is at least partly restricted. In FIG. 9*b*, the closing member is shown in a closed position.

In one end, the arm member 61 comprises a through hole 67 extending from one side of the arm member to an opposite side. The through hole defines a circumferential wall 671 constituted by the arm member 61. The circumferential wall 671 comprises a multiplicity of grooves 672 having faces and protrusions 673. The grooves and protrusions are arranged along the circumference of the hole and extend from one side of the arm member to the opposite. As shown in FIG. 3, the inlet 651 of the fluid influx channel 65 and the outlet 662 of the fluid reflux channel 66 are provided in the circumferential wall 671. The inlet 651 and the outlet 662 may each be provided in either one of the faces of the grooves, on the protrusions, or a combination thereof. By arranging the inlet and the outlet in separate grooves or on separate protrusions, it is easier to establish a fluid-tight connection to the inlet and the outlet, respectively.

FIG. 3 further shows how a torque member 70 is received in the through hole. The torque member 70 is constituted by a shaft part 71 and a crank arm 72 projecting substantially radially from one end of the shaft part. The shaft part 71 extends between a first end 712 and a second end 713 and comprises an encircling arm member interface 73 close to the first end. The arm member interface 73 comprises multiple protrusions having outer faces 74 and grooves 714 extending in a longitudinal direction of the shaft part 71. The grooves and protrusions are arranged along a periphery of the shaft part and adapted to engage with the corresponding grooves and protrusions of the circumferential wall 671 encircling the through hole 67.

The multifaced geometry of the arm member interface and the corresponding through hole in the arm member are adapted for transferring a torque between the torque member 70 and the arm member 61. By arranging the arm member interface of the torque member in the through hole of the arm member 61, the outer faces 74 of the arm member interface mate with corresponding faces 672 of the grooves in the wall encircling the through hole. The torque member 70 is thereby rotatably secured to the arm member 61.

The torque member 70 comprises a first fluid channel 75, denoted as a fluid supply channel 75, extending between an inlet 751 arranged substantially in the centre of the shaft part at a first end 712 and an outlet 752 arranged in an outer face 74 (shown in FIG. 4) of the arm member interface 73. The torque member further comprises a second fluid channel 76, denoted a fluid return channel 76, extending between an inlet 761 arranged in the outer face 74 different from the outer face in which an outlet 762 of the fluid supply channel is arranged, and the outlet 762 provided in the second end 713 of the shaft part. By having the outlet 752 and the inlet 761 arranged on separate faces as shown in FIG. 4, the sealing properties are improved, whereby the risk of cross-flow between the fluid supply channel and the fluid return channel is reduced. The fluid supply channels run through internal parts of the torque member 70 and may be e.g. drilled, machined or cast in a manner known to the person skilled in the art.

When the torque member is received in the through hole, the outlet of the fluid supply channel is arranged on a face opposite a corresponding face comprising the inlet of the fluid influx channel. Likewise, the outlet of the reflux channel of the arm member is arranged on a face opposite a corresponding face comprising the inlet of the fluid return channel of the torque member. By arranging an inlet and an outlet on two corresponding, opposite and abutting faces, a substantially fluid-tight connection between the outlet and the inlet is provided. In this regard, the fit between the faces, i.e. between the arm member interface of the torque member and the through hole in the arm member, is of great importance to the sealing properties of the connection. Proper tolerances in this respect are known to the person skilled in the art. By fluidly connecting the outlet 752 of the fluid supply channel 75 with the inlet 651 of the fluid influx channel 65, and fluidly connecting the outlet 662 of the fluid reflux channel 66 with the inlet 761 of the fluid return channel 76, the fluid channels 65, 66, 85 of the arm member 61 are in fluid communication with the fluid channels 75, 76 of the torque member 70. Thus, hydraulic fluid may be supplied into the arm member 61 via the torque member 70.

FIG. 4 shows another design of the arm assembly wherein a bore 68 is provided in the arm member in the same end as the through hole. The bore extends from a side of the arm member and into the through hole and is adapted to receive a tube member, described in more detail below. The inlet 651 of the fluid influx channel is arranged in a wall encircling the bore, and the fluid influx channel 65 is thus fluidly connected with the through hole via the bore. The fluid reflux channel 66 extends from the inlet 661 in the motor housing 25 to the outlet 662 in the circumferential wall 671 without intersecting the bore. When the arm member is viewed as shown in FIG. 4, the fluid reflux channel thus extends below the bore.

The fluid influx and reflux channels 65, 66, 85 extend through a massive part of the arm member 61 and may be drilled, machined, cast, etc. into the arm member. As shown in FIG. 3, the fluid influx 65 channel and fluid reflux 66 channel extend in individual planes of the arm member from the member interface 73 towards the motor housing. By being arranged in individual planes the fluid influx and reflux channels 65, 66, 85 may cross each other and be arranged above or below each other. The fluid influx and reflux channels 65, 66, 85 may also be displaced in a transversal direction of the arm member as shown in FIG. 4. If displaced transversely, the fluid influx and reflux channels may extend in the same plane of the arm member from through hole towards the motor housing. Both the fluid influx channel 65 and the fluid reflux channel 66 may individually extend through different planes of the arm member and run in alternating direction between the arm member interface 73 and the motor housing 25. The fluid influx and reflux channels 65, 66, 85 may thus comprise bending sections and bends changing the direction of the fluid channels 65, 66, 85.

FIG. 4 further shows the tube member 69 mentioned above. The tube member 69 is arranged in the bore and provides an improved fluid communication between the fluid supply channel 75 of the torque member 70 and the fluid influx channel 65 of the arm member. The tube member 69 extends along the length of the bore 68 with a first end 692 of the tube member 69 extending further into an outlet of the fluid supply channel of the torque member. Besides fluidly connecting the fluid supply channel 75 and the fluid influx channel 65, the tube member secures the torque member 70 in the through hole.

The tube member 69 comprises an inner bore 694 extending between an inlet in the first end 692 and an outlet 695 provided in a side wall of the tube member 69. The inner bore 694 fluidly connects the fluid supply channel 75 of the torque member 70 with the influx fluid channel 65 of the arm member 61 when the tube member is arranged in the bore. By the tube member 69 comprising a seal 691 provided in the first end 692 adjacent the inlet, the sealing properties of the connection between the fluid supply channel 75 of the torque member 70 and the inner bore 694 of the tube member 69 is improved, and consequently the entire fluid supply to the hydraulic motor 23 is improved. Providing a fluid-tight fluid supply is of considerable importance in relation to the sealing quality of the drainage for the hydraulic motor 23. The fluid supplied to the hydraulic motor 23 must be under a substantial pressure for the motor to work properly. If the pressure is too low, e.g. due to a leaking fluid supply, the hydraulic motor 23 will be unable to provide the necessary force to propel the downhole tool 11. The tube member 69 may be designed as a threaded bolt arranged in a threaded connection with the arm member 61, or designed in any other suitable manner known to the person skilled in the art.

Figure 5:
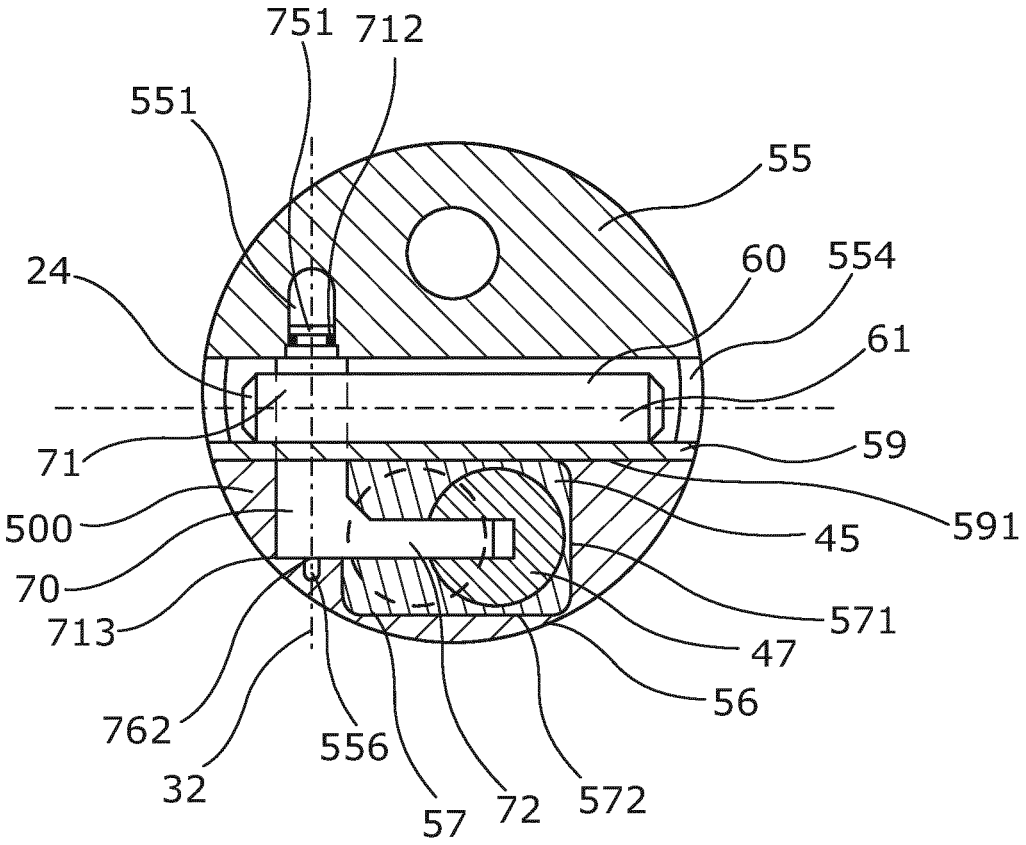
FIG. 5 shows a cross-sectional view of a downhole tool transverse to the longitudinal direction.
Figure 6:
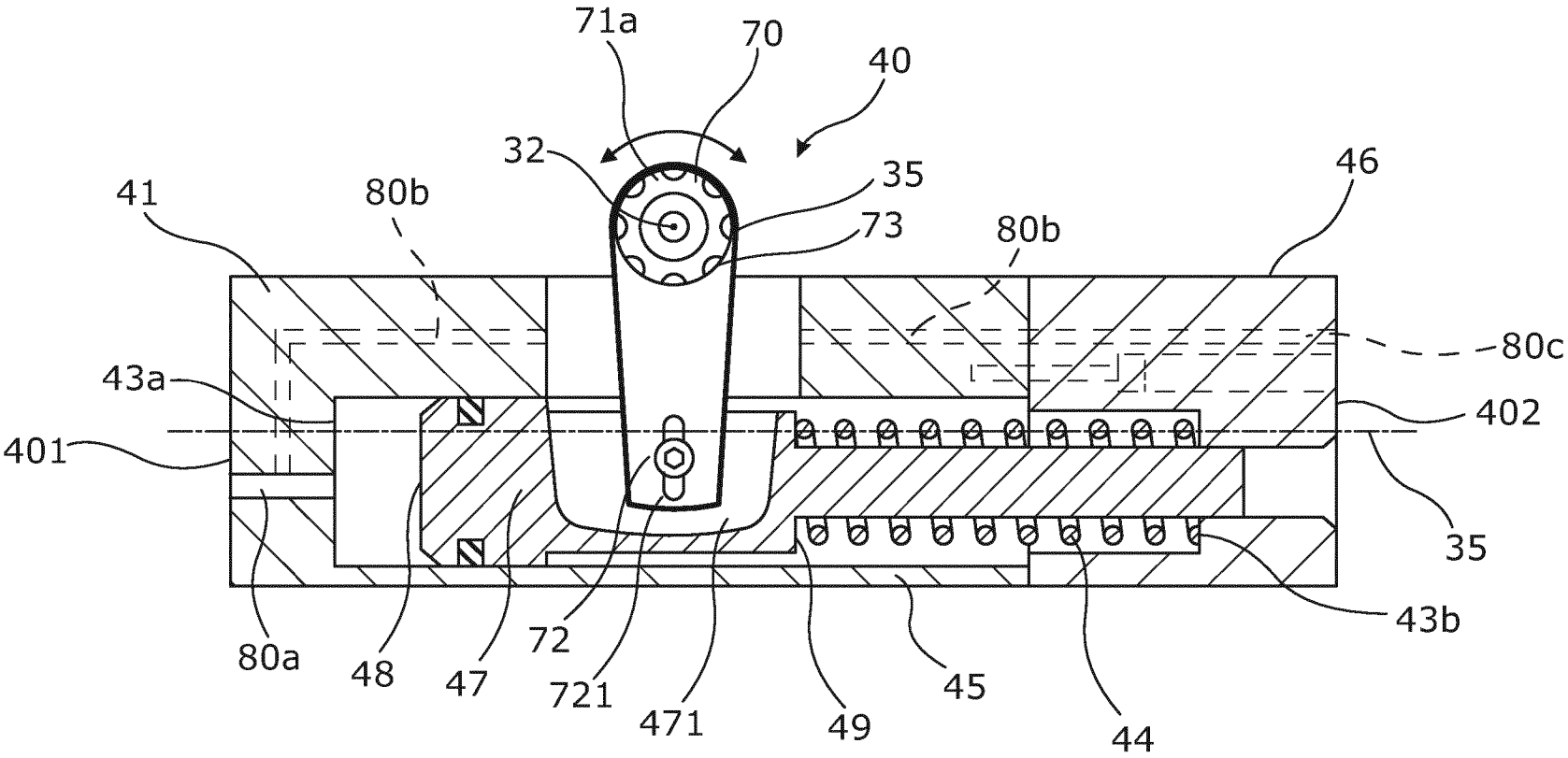
FIG. 6 shows a cross-sectional view of an arm activation assembly.

The torque member 70 is part of the arm activation assembly 40 shown in FIG. 6. The arm activation assembly 40 is arranged inside the tool housing 54 of the downhole tool 11 as shown in FIG. 5 and provides the force required to move the arm assembly between the retracted position and the projecting position. The arm activation assembly 40 comprises a piston housing 41 having a piston chamber 42 extending in the longitudinal direction of the downhole tool 11. The piston housing 41 is divided into a first piston housing part 45 and a second piston housing part 46, and the piston chamber 42 extends into both piston housing parts. The first piston housing part 45 defines a first end face 43*a* of the piston chamber 42, and the second piston housing part defines a second end face 43*b* of the piston chamber 42. Inside the piston housing 41, a piston member 47 is arranged which is movable in the longitudinal direction of the downhole tool 11. The piston member 47 is moved in a first direction towards the second end face 43*b* by a fluid acting on a first piston surface 48. The fluid is supplied to a part of the piston chamber 42 in front of the piston member 47 via fluid channel 80*a*. Further, a spring member is arranged in the piston chamber 42 to move the piston member 47 in a second direction opposite the first direction towards the first end face 43*a* of the piston chamber 42. It is obvious to the person skilled in the art that the coiled spring may be replaced by e.g. a gas piston or other resilient member capable of exerting a force when it has been compressed.

The torque member 70 described above is connected to and rotated by the piston member 47. The torque member thereby converts the reciprocation of the piston member into a rotation force rotating the arm assembly 60. The crank arm 72 of the torque member 70 is connected with the piston member 47 by the crank arm being arranged in a recess 471 in the piston member 47 and fastened by a sliding pivot joint as shown in FIG. 6. However, the torque member 70 may be connected to the piston member 47 using various design principles such as, but not limited to, a rack also known as a toothed rack or gear-rack, a worm shaft or a sliding pivot joint.

FIG. 5 shows a cross-section of the downhole tool 11, illustrating how the tool housing 54 is divided into a first tool housing part 55 and a second tool housing part 56. Further, it is shown how the first end 712 of the torque member 70 extends into the first tool housing part 55, and the second end 713 extends into the second tool housing part 56. The first tool housing part 55 comprises a fluid supply channel 551, and the second tool housing part 56 comprises a fluid return channel 556. The inlet 751 of the fluid supply channel 75 (shown in FIG. 3) of the torque member 70 is in fluid communication with the fluid supply channel 551 of the first tool housing part 55, and the outlet 762 of the fluid return channel 76 (shown in FIG. 3) of the torque member 70 is in fluid communication with the fluid return channel 556 of the second tool housing part 56. Hereby, fluid may be supplied through the inlet 751 of the fluid supply channel, and drainage is provided through the outlet 762 of the fluid return channel.

The hydraulic pump of the downhole tool 11 may be used for supplying hydraulic fluid under pressure to the fluid supply channel 551 of the first tool housing part 55. Hereby, hydraulic fluid is supplied to the hydraulic motor 23 via the integrated fluid supply channel in the torque member 70 and the fluid influx channel in the arm member 61. By supplying hydraulic fluid from the hydraulic pump to the hydraulic motor 23, the hydraulic motor is propelled by the hydraulic pump. Alternatively, pressurised hydraulic fluid may be supplied to the fluid supply channel 551 of the first tool housing part 55 by means of coiled tubing or another kind of hose system connected to the downhole tool 11. In this way, the hydraulic fluid utilised may be pressurised externally to the downhole tool, e.g. at the surface of the well.

Further, FIG. 1 shows how the downhole tool 11 may be connected to one or more operational downhole tools 12, thereby constituting a tool string 10. Such operational tools could be a stroker tool providing an axial force in one or more strokes, a key tool opening or closing valves in the well, positioning tools such as a casing collar locator (CCL), a milling tool, a drilling tool, a logging tool, etc.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole tool extending in a longitudinal direction, comprising:

a tool housing, an arm assembly movable between a retracted position and a projecting position in relation to the tool housing, the arm assembly comprising an arm member connected with the tool housing in one end, the arm assembly including a rotational part to propel the downhole tool in a well, the rotational part including a wheel ring structured to provide traction against a side wall of a well casing, an arm activation assembly arranged in the tool housing for moving the arm assembly between the retracted position and the projecting position, and a pump for circulating hydraulic fluid, wherein the arm assembly comprises a hydraulic mechanism at least partly arranged in the rotational part, and an internal fluid influx channel provided in the arm member and extending to the wheel ring, the internal fluid influx channel being in fluid communication with the hydraulic mechanism for supplying hydraulic fluid from the pump to the hydraulic mechanism for retracting and projecting the arm assembly, driving said hydraulic mechanism and rotating said rotational part and the wheel ring.

2. A downhole tool according to claim 1, wherein the hydraulic mechanism is a hydraulic motor or a hydraulic cylinder, and the fluid influx channel is fluidly connected with the hydraulic motor or hydraulic cylinder for supplying hydraulic fluid from the pump to the hydraulic mechanism.

3. A downhole tool according to claim 2, wherein the rotational part is connected with the hydraulic motor, whereby the rotational part is rotated by the hydraulic motor to propel the downhole tool in a well.

4. A downhole tool according to claim 3, the arm assembly further comprising a motor housing arranged at one end of the arm member, and the motor housing and the rotational part defining an inner space in which the hydraulic motor is arranged, wherein an outlet of the fluid influx channel and an inlet of the fluid reflux channel are fluidly connected to the inner space.

5. A downhole tool according to claim 4, the motor housing comprising a circumferential housing wall constituted by a protruding part of the arm member, whereby the motor housing is provided as an integrated part of the arm member.

6. A downhole tool according to claim 3, wherein the rotational part forms a sealed closure for a housing of the hydraulic mechanism.

7. A downhole tool according to claim 1, wherein a fluid reflux channel is provided in the arm member, the fluid reflux channel being in fluid communication with the hydraulic mechanism to drain hydraulic fluid from the hydraulic mechanism.

8. A downhole tool according to claim 1, the arm member further comprising a through hole extending from one side of the arm member to another, thereby defining a circumferential wall, and the arm activation assembly further comprising a torque member recieved in the through hole, thereby connecting the arm member with the arm activation assembly.

9. A downhole tool according to claim 8, wherein an inlet of the fluid influx channel and an outlet of the fluid reflux channel are arranged in the circumferential wall encircling the through hole.

10. A downhole tool according to claim 8, wherein the circumferential wall encircling the through hole comprises multiple grooves and protrusions extending from one side of the arm member to another, and wherein the multiple grooves of the circumferential wall are adapted to receive corresponding protrusions provided in the torque member.

11. A downhole tool according to claim 8, the torque member comprising a first fluid channel fluidly connected to the fluid influx channel of the arm member and a second fluid channel fluidly connected to the fluid reflux channel of the arm member.

12. A downhole tool according to claim 8, the arm activation assembly comprising a piston chamber and a piston member movable in the longitudinal direction of the downhole tool and arranged inside the piston chamber, wherein the torque member is rotated by the piston member to move the arm assembly between the retracted position and the projecting position.

13. A downhole tool according to claim 8, the arm assembly further comprising a tube member arranged in a bore provided in the arm member, the bore extending from one side of the arm member to the through hole, wherein a first end of the tube member extends through the bore and into engagement with one of the fluid channels of the torque member recieved in the through hole, whereby the torque member is secured in the through hole of the arm member.

14. A downhole tool according to claim 13, the tube member comprising an inner bore extending between an inlet arranged in the first end of the tube member and an outlet provided in a side wall of the tube member, wherein the tube member fluidly connects the first fluid channel of the torque member and the fluid influx channel of the arm member.

15. A downhole system comprising the downhole tool according to claim 1 and an operational tool connected with the downhole tool for being moved forward in a well or borehole.

16. A downhole system according to claim 15, wherein the operational tool is a stroker tool, a key tool, a milling tool, a drilling tool, or a logging tool.

17. A downhole tool according to claim 1 further comprising a plurality of arm assemblies and a hydraulic mechanism for each arm assembly.

* * * * *